US006080000A

United States Patent [19]

Baker et al.

[11] Patent Number: 6,080,000

[45] Date of Patent: Jun. 27, 2000

[54] CAM-IN EDGE-CARD CONNECTOR

[75] Inventors: Robert William Baker, Kenton; Jim Braithwaite, St. Albans; Robert Scott Turnbull, Glasgow, all of United Kingdom

[73] Assignee: The Whitaker Corporation, Wilmington, Del.

[21] Appl. No.: 09/142,386

[22] PCT Filed: Mar. 12, 1997

[86] PCT No.: PCT/IB97/00251

§ 371 Date: Sep. 4, 1998

§ 102(e) Date: Sep. 4, 1998

[87] PCT Pub. No.: WO97/35365

PCT Pub. Date: Sep. 25, 1997

[30] Foreign Application Priority Data

Mar. 18, 1996 [GB] United Kingdom ..... 9605674

[51] Int. Cl.[7] ..... H01R 13/62

[52] U.S. Cl. ..... 439/326

[58] Field of Search ..... 439/326, 327, 439/328, 629, 630, 636

[56] References Cited

U.S. PATENT DOCUMENTS

| | | | |
|---|---|---|---|
| 4,575,172 | 3/1986 | Walse et al. | 339/75 MP |
| 4,737,120 | 4/1988 | Grabbe et al. | 439/326 |
| 4,747,750 | 5/1988 | Chlus et al. | 415/172 A |
| 4,850,891 | 7/1989 | Walkup et al. | 439/326 |
| 5,061,200 | 10/1991 | Yang Lee | 439/326 |
| 5,064,381 | 11/1991 | Lin | 439/326 |
| 5,085,593 | 2/1992 | Tuan | 439/326 |
| 5,249,988 | 10/1993 | Lu | 439/326 |
| 5,411,408 | 5/1995 | DiVesti et al. | 439/326 |
| 5,437,560 | 8/1995 | Mizuguchi | 439/326 |
| 5,807,128 | 9/1998 | Sakata et al. | 439/326 |
| 5,888,086 | 3/1999 | Yaegashi et al. | 439/326 |
| 5,897,390 | 4/1999 | Yamagami et al. | 439/326 |

FOREIGN PATENT DOCUMENTS

| | | | |
|---|---|---|---|
| WO 88/07271 | 9/1988 | WIPO | H01R 23/70 |

OTHER PUBLICATIONS

See PCT International Search Report for any references that are not enclosed herewith.

*Primary Examiner*—Neil Abrams
*Assistant Examiner*—Hae Moon Hyeon

[57] ABSTRACT

A cam-in DIMM card connector comprises camming protrusions provided on flexible side walls that rotationally guide a board into latching engagement with the connector. In the fully latched position the board is levered firmly between a top corner and opposing side wall of the board receiving slot in order to straighten any warping in the board. Greater dimensional tolerance can therefore be supported by the connector.

20 Claims, 5 Drawing Sheets

CAM-IN EDGE-CARD CONNECTOR

BACKGROUND OF THE INVENTION

This invention relates to a connector for mating with a printed circuit board by means of a pivoting cam-in assembly, for applications such as Dual In-Line Memory Modules (DIMM).

SUMMARY OF THE PRIOR ART

In applications such as SIMM (Single In-Line Memory Module) and DIMM (Dual In-Line Memory Module) cards for computer systems, memory chips on a printed circuit are interconnected by circuit traces to a plurality of juxtaposed circuit pads arranged along the edge of the card, which can then be plugged into a connector, for interconnecting the memory modules to a computer. In many applications, the card must be unpluggable in order to exchange or replace the card. The contact pads arranged along the edge of the card are usually provided on either side of the card.

In SIMM cards, aligned contact pads on opposite sides of the board are electrically interconnected. The connector typically has edge-stamped contacts for contacting contact pads on both sides of the board, for example as shown in U.S. Pat. No. 4,575,172, where each contact has a pair of contact points abutting opposed aligned contact pads of the PCB. Adjacent contacts are closely spaced together, in order to have a large number of connections in one connector. Due to the high mating forces, low insertion force (LIF) plugging systems are therefore provided. One common LIF means is to cam-in the board by pivoting action as described in U.S. Pat. No. 4,575,1272.

In U.S. Pat. No. 4,747,790, an example of both direct plug-in and pivot cam-in is shown for a connector with leaf-spring contacts. Contacts used in DIMM connectors are electrically separate on either side of a printed circuit board. It is typical to use leaf-spring contacts that have a greater flexibility than the edge-stamped contacts often used in SIMM card connectors. In DIMM card connectors the contacts are usually gold plated. The gold plating permits lower contact forces as the formation of resistive oxide layers is avoided. Due to the lower contact forces, it is typical to simply plug-in edge-cards into DIMM connectors in a linear direction, although it is also known to pivotly cam-in the board if mating force reduction is required.

One of the problems of edge-card connector systems, in particular with a large number of contacts extending over a significant length, is that the contact may not be effected reliably if the printed circuit board is excessively warped. The longer the edge-card, the greater this problem becomes. The problem is aggravated by the desire to have a higher density of connections, which leads to smaller terminals, resulting in a reduction of their elastic displacement range. Such problems affect both DIMM and SIMM card connectors.

Manufacturing the boards within certain tolerances increases their costs. In view of the large number of applications, it is also difficult to ensure that boards with specified tolerances will always be used with a particular connector, therefore affecting the reliability of such connections. It would therefore be desirable to provide a connection system that accommodates the above mentioned problems in a more reliable, yet cost effective manner.

SUMMARY OF THE INVENTION

It is therefore an object of this invention to provide an edge-card connector that provides a reliable connection to an edge card, in particular to overcome problems of tolerances in thickness or bending of the edge card.

It is an object of this invention to provide a low insertion force edge-card connector that ensures reliable and secure connection.

It would be advantageous to provide a reliable low insertion force edge-card connector that ensures reliable contact to an edge-card with tolerances in bending or thickness, in a cost effective manner.

Objects of this invention have been achieved by providing an edge-card connector according to the claims. In particular, by providing an edge card connector comprising a housing having a slot for receiving the edge of a printed circuit board therein and electrical terminals extending alongside the slot, wherein the latch is dimensioned with respect to opposing side walls of the slot in such a manner as to ensure resilient abutment of opposing sides of the board, against opposing sides of the slot in the fully mated position. Advantageously therefore, any excessive warpage in the board is straightened by resilient abutment with the opposing sides of the slot.

The slot can be dimensioned such that in the fully mated position, one side of the board is resiliently biased against a top edge of one side of the slot, the edge thereby concentrating the bending forces to improve the straightening effect.

The connector can be provided with a camming guide that engages the board shortly after rotation from the insertion position, guiding the board during pivotal movement to the fully mated position. In order to follow the pivotal movement, the camming guides could be provided with an arcuate shape. The camming guides have the advantage of not only preventing insertion of the board at an incorrect angle, but also maintain the board securely in the slot during the pivoting movement thereby assisting the mating operation and preventing damage to the connector by faulty insertion and rotation.

The arcuate camming members and latching means could advantageously be provided on both longitudinal ends of the connector, on sides walls extending above the connector slot and integrally formed with the connector housing for a cost effective solution.

Reliability of the connection can be further enhanced by increasing the elastic range of the terminals. The latter is achieved by positioning the retention features of the terminals, for retention to the connector housing proximate a mounting face of the connector remote from the edge-card receiving end. The aspects and advantages of this feature will be more apparent in the following description.

Further advantageous aspects of the invention are described in the claims or will be apparent from the following description and drawings.

DETAILED DESCRIPTION OF THE PREFERRED EMBODIMENT

Figure 1:
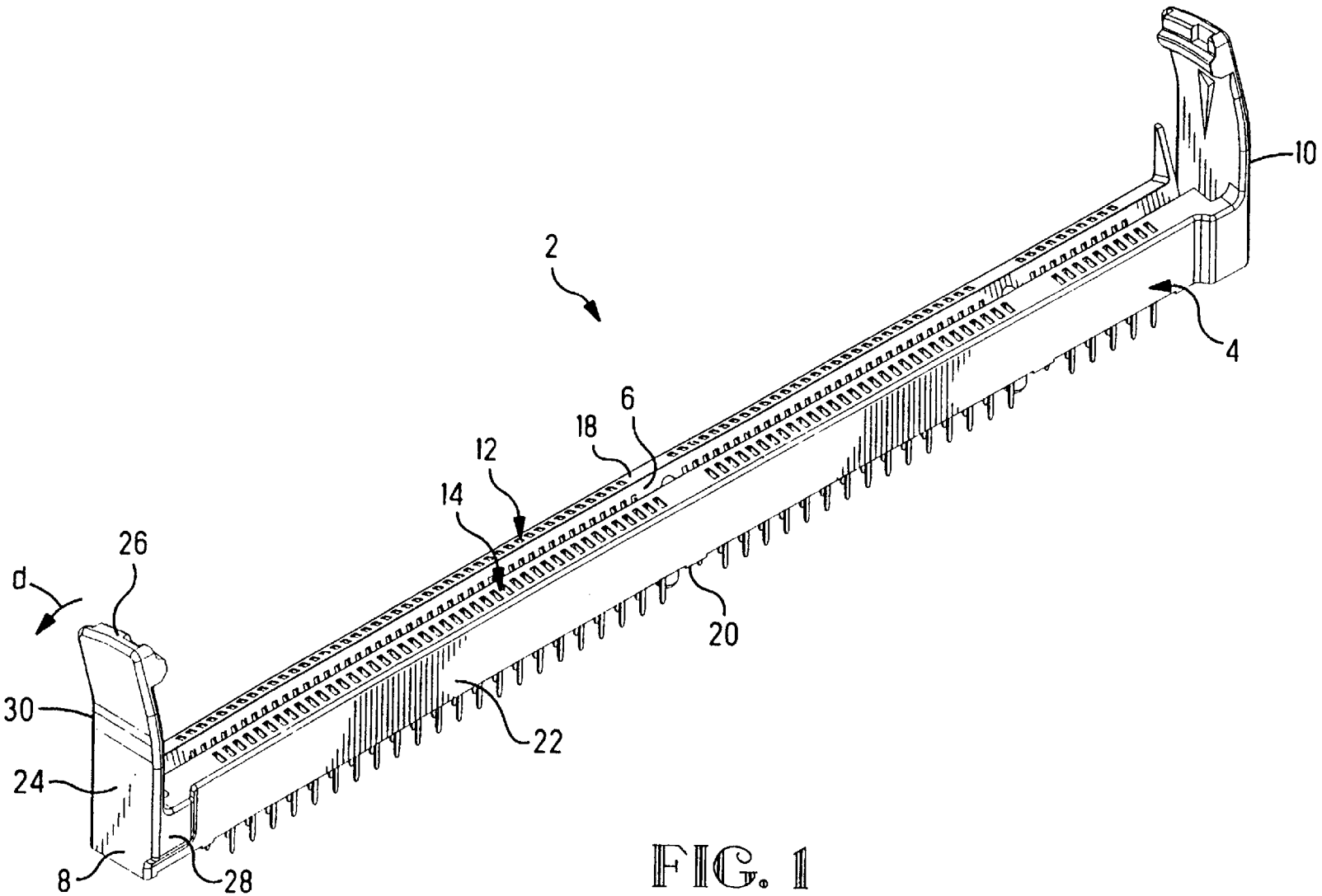
FIG. 1 is an isometric view of a connector according to this invention.
Figure 2:
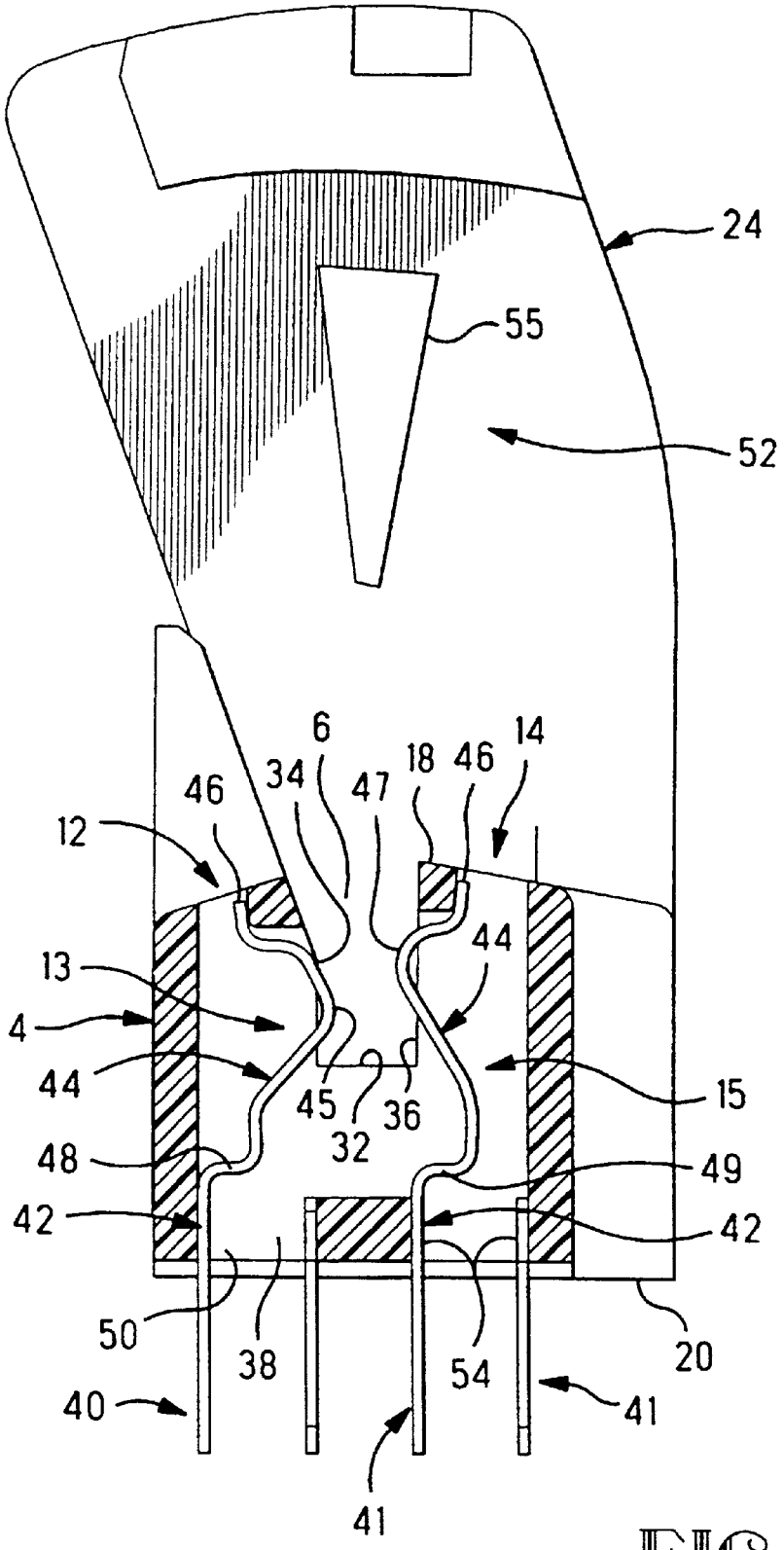
FIG. 2 is a cross-sectional view through a connector according to this invention.

Referring to FIGS. 1 and 2, an edge-card connector 2 comprises an insulative housing 4 having a card receiving slot 6 extending longitudinally from the first end 8 to an opposed second end 10, and two rows 12,14 of electrical terminals 13,15 positioned either side of the slot 6 for electrically contacting circuit traces of a printed circuit board 16 (see FIGS. 5 and 6) inserted therein. The connector housing 4 has an upper card receiving face 18, a lower mounting face 20 opposed thereto for positioning on a printed circuit board, longitudinal side walls 22, and end walls 24 that extend upwards beyond the card receiving face 18 to upper free ends 26. The end walls 24 are attached to the housing on one side or attached end 28 only such that the end wall 24 is resiliently biasable outward in the direction D, as shown in FIG. 1, at an edge 30 opposed to the attachment end side 28.

Referring to FIG. 2, the card receiving slot 6 comprises a bottom face 32, a first side face 34 alongside the first row 12 of terminal 13, and a second side face 36 alongside the second row 14 of terminal 15. The housing 4 further comprises contact receiving cavities 38 extending from the mounting face 20 to the board receiving face 18 for receiving the contacts 13,15 therein. Both the contacts 13 and 15 comprise a connection section 40, in this embodiment comprising pins for mounting in a printed circuit board, a retention section 42 for secure retention to the housing 4, and a cantilever beam spring-arm 44 extending to a free end 46 proximate the board receiving face 18. The spring-arm comprises a contact section 45,47 respectively of the first and second contacts 13,15 protruding beyond the slot side faces 34,36 respectively. Between the retention section 42 and spring-arm 44 is a transition portion 48,49 that interconnects the contact arm to the retention section.

Figure 3:
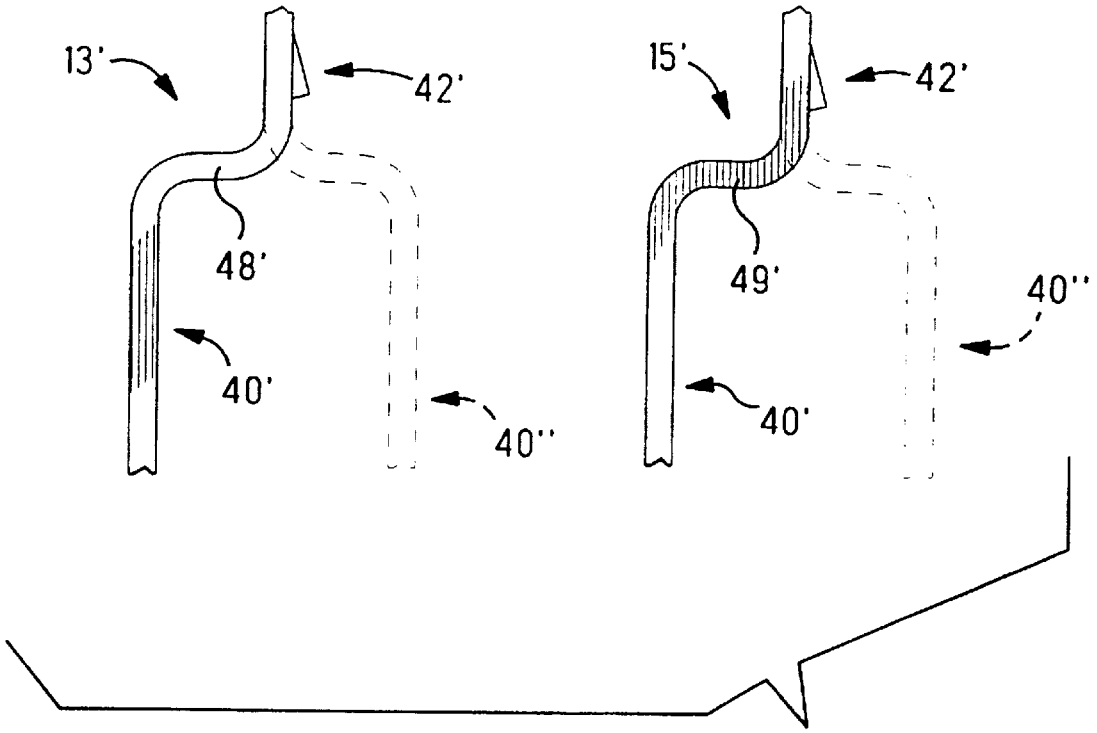
FIG. 3 is a side view showing mounting portions of terminals of a conventional connector.

Referring to FIG. 3, the transition and retention sections 48',49' and 42' of first and second contacts 13' and 15' of a conventional connector are shown. The dotted line represents the mounting portion 40" of the contact column adjacent to the contacts with the mounting portion 40'. In other words, adjacent contacts have their mounting portions 40',40" offset such that the contacts can be placed closer together whilst nevertheless having a large and sturdy retention section. The latter also enables a denser packing of the mounting portions on a printed circuit board. Switching the mounting portion 40',40" either side of the contact spring arm for adjacent contacts, is termed hereinafter as "joggling". In the conventional connector shown in FIG. 3, the joggling occurs below the retention portion 42' which serves to securely fasten the terminals within a connector housing. The retention feature 42' reduces the overall spring arm length and therefore its flexibility (i.e. elastic displacement range).

Figure 4:
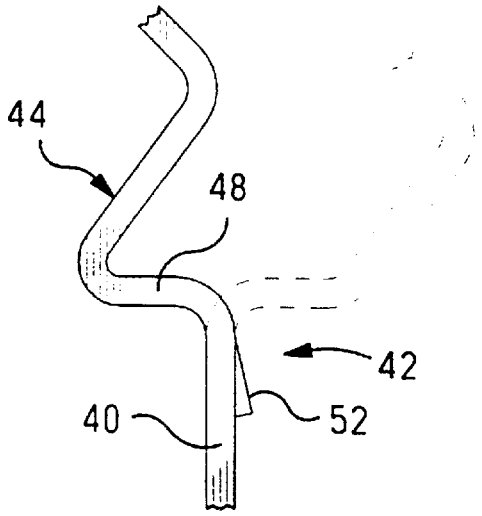
FIG. 4 is a side view of part of a terminal according to this invention.

In the present invention, and in particular referring to FIG. 4, the retention section 42 is provided below the transition portion 48, the joggling occurring therefore above the retention section 42 such that the transition portion 48 adds to the elasticity of the spring-arm 44. A more flexible contact is thus provided (or the contact can be made more compact) than the prior art solution. The contacts 13,15 are assembled in the cavities 38 by stitching the contacts from the mounting face 20 through passages 50 (see FIGS. 2 and 5*a*), that communicate the cavities 38 with the mounting face 20. The retention portion 42 may comprise a retention barb 52 or 53 extending laterally from the plane of the contact that engages in an interference fit in a corresponding slot 54 in the housing. The slot 54 could be provided as a continuous longitudinal slot, whereby the barbs would be provided as in 52, projecting transversely out of the plane of the retention portion 42. In FIG. 2, one can see the mounting portions 41 of adjacent contacts that are joggled with respect to the mounting portions 40 of the terminals 13,15.

Figure 5A:
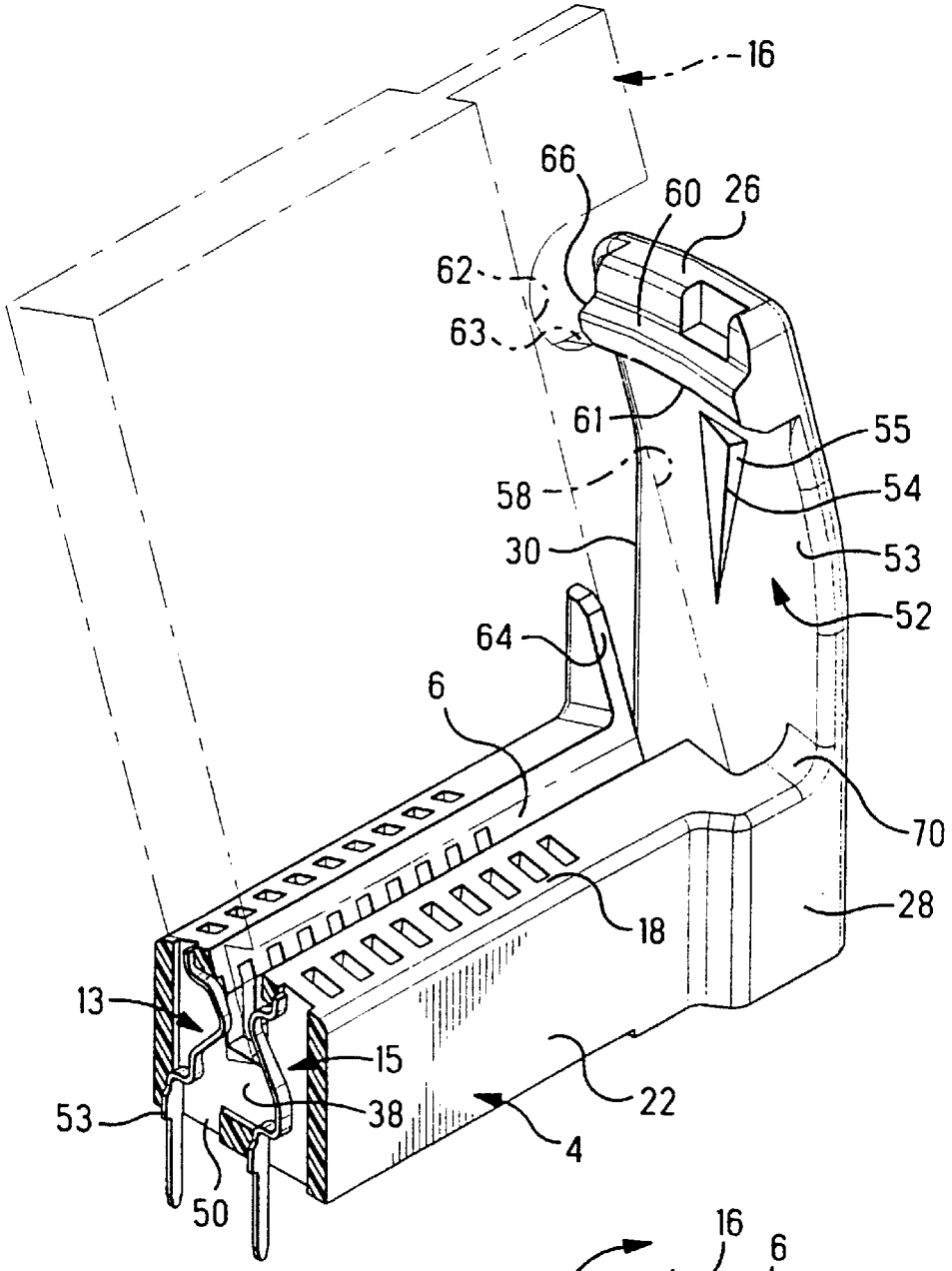
FIG. 5*a* is an isometric view of part of a connector according to this invention and a board being plugged thereinto.
Figure 6A:
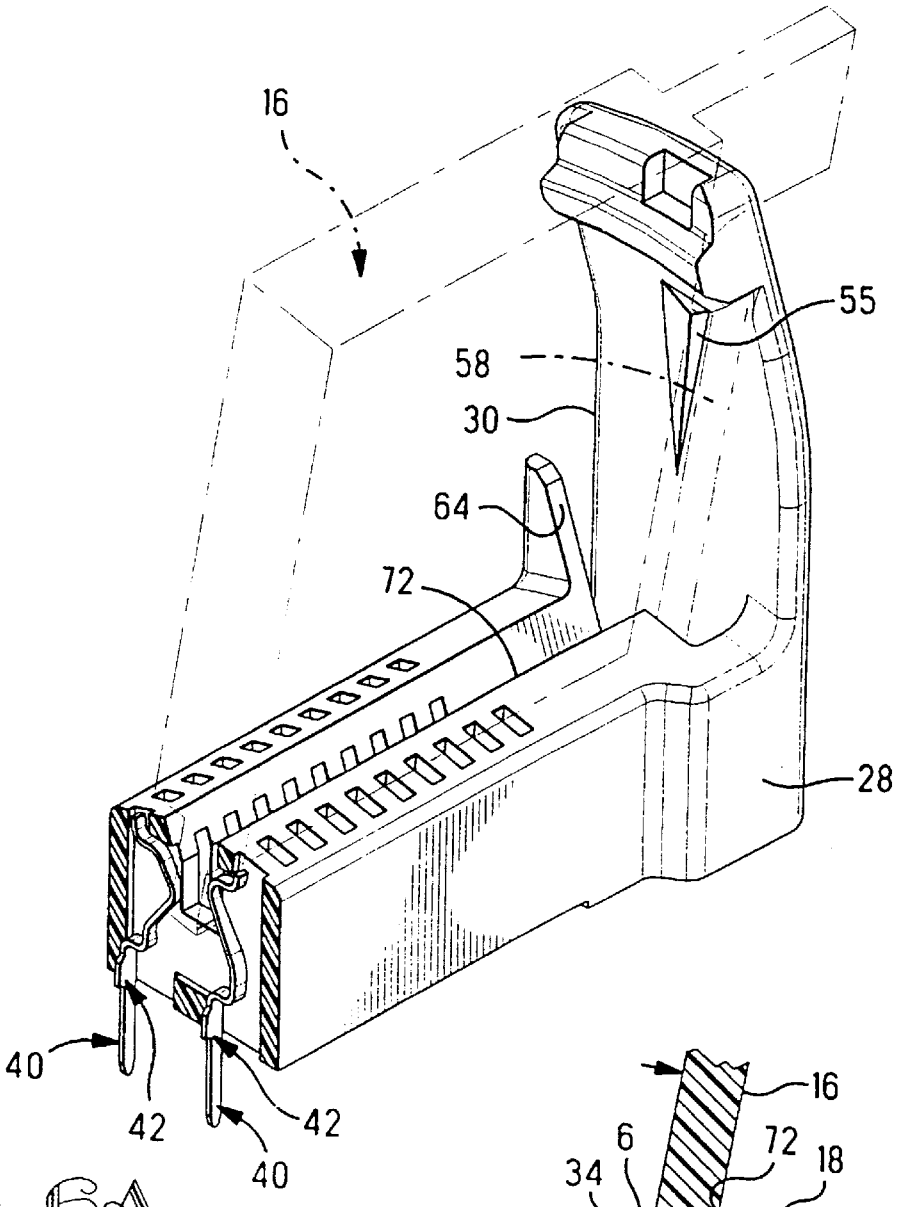
FIG. 6*a* is a view similar to FIG. 5*a*, but with the board in the fully mated position.

Referring mainly to FIGS. 5*a* and 2, the housing is shown comprising a latching member 52 comprising a portion 53 of the end wall 24 that extends above the board receiving face 18, and a latching protrusion 54 having a locking shoulder 55 engageable against an edge 58 of a printed circuit board 16 when fully mated therewith as shown in FIG. 6*a*. At the free end 26 of the resilient end wall 24, is provided a camming protrusion 60 protruding toward the connector and having an arcuate shape with shoulder 61 enabling rotational engagement with a corresponding shoulder 63 formed from a groove or recess 62 in the printed board 16.

The connector further comprises an insertion guide 64 projecting above the slot 6, to help guide the printed circuit board 16 into the slot 6, in conjunction with an insertion guide end 66 of the camming protrusion 60. Cooperation of the camming member insertion guide 66 and the insertion guide 64 ensures that the board 16 is positioned and guided at a specific angle when inserted into the connector slot 6. This prevents the board from being inserted at an incorrect angle that could damage the terminals 13,15 within the connector. When the board abuts the bottom face 32 of the slot 6 the groove 62 aligns with the camming protrusion 60. The board can then be pivoted, whereby the camming protrusion 60 engages in the groove 62 until latching of the protrusion 54 with the edge 58 of the board. The latching protrusion 54 is provided with resiliency (to enable engagement with the board) by the resiliency of the end wall portion 52, due to the cantilever attachment of the end wall. The resiliency of the end wall is further enhanced by separation of the end wall at the insertion end 30 from the connector body below the board receiving face 18. This gives the effect of pivotly "hinging" the latch member 52 at an attachment end 70 at one side 28 of the housing 4.

Figure 5B:
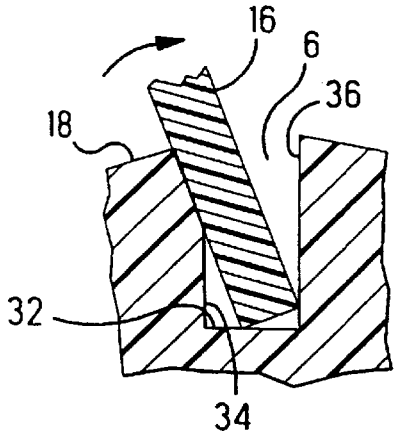
FIG. 5*b* is a schematic cross-sectional view illustrating a first insertion position of the board.
Figure 6B:
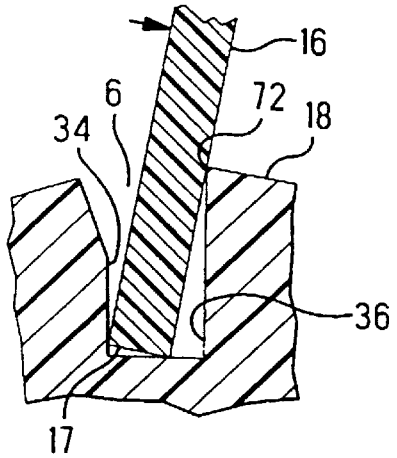
FIG. 6*b* is a schematic view similar to that of FIG. 5*b*, but showing the board in the fully mated position.

Referring mainly to FIGS. 5*b* and 6*b*, the board straightening effect of the invention will now be explained. Initially, as shown in FIG. 5*b*, the board is inserted into the slot 6 until abutment with the bottom face 32. The board is then pivoted, whereby the groove 62 engages the camming protrusion 60, to the fully mated position shown in FIG. 6*b*, where the latch protrusion 54 engages the board. In this fully mated position, the board is resiliently biased in abutment against an upper edge 72 of the slot 6 at the board receiving face 18, of the slot side face 36. Simultaneously, the lower end 17 of the board 16 abuts against the opposing slot side face 34. The latch protrusion is dimensioned in such a manner as to provide a resilient force (the elastic energy being stored in the connector and the board) that straightens any warping in the board by engagement thereof against the upper corner 72 and opposite side wall 34 of the connector slots 6. The lever arm between the position of the latch protrusion 54, the upper corner 72 and the lower end 17 provides sufficient force to straighten the board.

During the pivoting movement of the board, the cam protrusion also engages the groove 62 along the whole rotational movement, which prevents partial removal of the board from the slot which could damage the contacts or produce bad electrical connection. Furthermore, the guiding facilitates assembly of the board to the connector by an operator. The provision of latching members 52 and camming members 60 at both ends 8,10 of the connector ensures stable guiding and latching.

The effects of straightening the board and increasing the elastic range of the contacts significantly improves the ability to absorb dimensional tolerances, and/or provide a higher density of contacts per length of board. Furthermore, the cooperating guide features and camming member prevent incorrect installation of the board into the connector thereby protecting the contacts and in addition facilitating the coupling of a board to the connector by an operator. By integrally molding the latching member and camming member to the connector housing end walls, a particularly cost effective connector is provided.

Advantageously, therefore, a reliable edge-card connector is provided that can absorb greater dimensional tolerances in the board, and protects the contacts from damage, in a cost effective manner.

What is claimed is:

1. A cam-in edge-card connector for pluggably receiving a circuit board, comprising a housing having a board receiving slot extending longitudinally between opposed ends of the housing, the slot accessible from a board receiving face of the housing and having a first side and a second side opposed to the first side and a bottom face, the connector further comprising at least one row of terminals extending alongside the slot, the slot and terminals adapted to receive the board at a first angle without any substantial insertion force, and further adapted to enable the board to rotate into a fully mated position, where the board engages with a latching member of the connector, characterized in that the latch member is dimensioned with respect to the slot in a manner to resiliently lever the board between a lower portion of the first side and an upper portion of the second side in the fully mated position for straightening any warping of the board.

2. The connector of claim 1 wherein the connector further comprises at least one arcuate camming shoulder engageable with a complementary shoulder on the board during rotation of the board from the insertion to the fully mated position.

3. The connector of claim 2 wherein at least one camming shoulder is provided at one longitudinal end of the connector.

4. The connector of claim 3 wherein the camming shoulder is provided on a camming protrusion that projects towards the other longitudinal end of the connector.

5. The connector of claim 4 wherein the connector comprises at least one insertion guide extending above the slot for guiding the board into the slot during insertion.

6. The connector of claim 5 wherein the insertion guide cooperates with the camming protrusion to guide insertion of the board at the insertion angle into the slot, whereby upon full insertion the camming shoulder and complementary shoulder on the board align to enable rotation thereof into the fully mated position.

7. The connector of claim 2 wherein the camming shoulder and latch member are provided on extensions of longitudinal end walls of the connector housing.

8. The connector of claim 7 wherein the camming shoulder and latch member are integrally formed with the housing.

9. The connector of claim 1 wherein the latch member is supported on an extension of the connector end wall projecting beyond the connector board receiving face, the end wall extension attached along one side of the connector housing to allow resilient biasing at the other side of the extension.

10. The connector of claim 1 wherein the terminals comprise spring contact arms for contacting the board, extending from mounting portions for connection to complementary conductors, the spring contact arms and mounting portions interconnected via respective transition sections that are joggled for adjacent contacts in the row, the contacts being retained to the housing by retention means positioned below the respective transition sections with respect to the upper board receiving face.

11. The connector of claim 1 wherein the board abuts an upper corner proximate the board receiving face of the second side of the slot.

12. A cam-in edge-card connector comprising a housing having a board receiving slot extending longitudinally between opposed ends of the housing, the slot accessible from a board receiving face of the housing and having first and second opposed sides and a bottom face, the connector further comprising at least one row of terminals extending alongside the slot, the slot and terminals adapted to receive the board in an insertion position at a first angle without any substantial insertion force, and further adapted to enable the board to rotate into a fully mated position where the board engages with a latching member of the connector, characterized in that the connector further comprises at least one arcuate camming shoulder engageable with a complementary shoulder on the board during rotation of the board from the insertion to the fully mated position.

13. The connector of claim 12 wherein said at least one camming shoulder is provided at one longitudinal end of the connector.

14. The connector of claim 13 wherein the camming shoulder is provided on a camming protrusion that projects towards the other longitudinal end of the connector.

15. The connector of claim 14 wherein the connector comprises at least one insertion guide extending above the slot for guiding the board into the slot during insertion.

16. The connector of claim 15 wherein the insertion guide cooperates with the camming protrusion to guide insertion of the board at the insertion angle into the slot, whereby upon full insertion the camming shoulder and complementary shoulder on the board align to enable rotation thereof into the fully mated position.

17. The connector of claim 12 wherein the camming shoulder and latch member are provided on extensions of longitudinal end walls of the connector housing.

18. The connector of claim 17 wherein the camming shoulder and latch member are integrally formed with the housing.

19. The connector of claim 12 wherein the latch member is supported on an extension of the connector end wall projecting beyond the connector board receiving face, the end wall extension attached along one side of the connector housing to allow resilient biasing at the other side of the extension.

20. The connector of claim 12 wherein the terminals comprise spring contact arms for contacting the board, extending from mounting portions for connection to complementary conductors, the spring contact arms and mounting portions interconnected via respective transition sections that are joggled for adjacent contacts in the row, the contacts being retained to the housing by retention means positioned below the respective transition sections with respect to the upper board receiving face.

* * * * *